US005956818A

United States Patent [19]

Tsubata

[11] Patent Number: 5,956,818

[45] Date of Patent: Sep. 28, 1999

[54] RETROREFLECTIVE FILAMENT SLIDE FASTNER

[75] Inventor: Noritaka Tsubata, Toyama-ken, Japan

[73] Assignee: YKK Corporation, Tokyo, Japan

[21] Appl. No.: 09/203,049

[22] Filed: Dec. 2, 1998

[30] Foreign Application Priority Data

Dec. 2, 1997 [JP] Japan ..... 9-331499

[51] Int. Cl.[6] ..... A44B 19/34

[52] U.S. Cl. ..... 24/397; 24/398; 24/391

[58] Field of Search ..... 24/391, 394, 397, 24/398, 409, 413; 2/243.1

[56] References Cited

U.S. PATENT DOCUMENTS

| | | | |
|---|---|---|---|
| 2,236,033 | 3/1941 | Killmer | 2/274 X |
| 3,768,125 | 10/1973 | Fröhlich | 24/396 |
| 4,922,585 | 5/1990 | Suzuki et al. | 24/389 X |
| 5,728,448 | 3/1998 | Okeya et al. | 24/413 X |

*Primary Examiner*—James R. Brittain
*Assistant Examiner*—Robert J. Sandy
*Attorney, Agent, or Firm*—Hill & Simpson

[57] ABSTRACT

The present invention provides a slide fastener which can exhibit a clear retroreflective phenomenon by providing retroreflective functions to filament fastener element rows and mounting threads. The retroreflective filament slide fastener of the invention includes filament fastener element rows formed from wire rods made of thermoplastic resin which have retroreflective layers formed by covering surfaces of the filament fastener element rows with retroreflective paint. A synthetic fiber thread is used as the mounting thread for mounting the filament fastener element rows to a fastener tape. The mounting thread is provided with a retroreflective layer by covering a surface of the synthetic fiber thread with the retroreflective paint, or winding or twisting a retroreflective film around or together with the synthetic fiber thread. Thus, the filament fastener element rows and the mounting thread which are the most conspicuous in the slide fastener can easily exhibit the retroreflective phenomenon.

9 Claims, 7 Drawing Sheets

RETROREFLECTIVE FILAMENT SLIDE FASTNER

BACKGROUND OF THE INVENTION

1. Field of the Invention

The present invention relates to a filament slide fastener, wherein fastener elements of the slide fastener are formed into coil or zigzag types from monofilament made of thermoplastic resin and a retroreflective function is applied to fastener element rows.

2. Description of the Related Art

There is a slide fastener having a retroreflective function, as disclosed in Japanese Patent Laid-open Publication No. 64-20806, comprising fastener elements made of synthetic resin by injection molding on side edges of fastener tapes, a hemispherical recessed hole and a reflector face formed in a surface of each the fastener element, and a glass bead with its lower half portion buried in the recessed hole using a transparent glass adhesive, the recessed hole having a larger diameter than the glass bead.

There is another slide fastener, as disclosed in Japanese Patent Publication No. 4-79242, comprising fastener elements mounted on side edges of fastener tapes and retroreflective tapes mounted on surfaces of the fastener elements in a longitudinal direction, the fastener elements being unitized bodies or of filament made of synthetic resin or being fastener elements made of metal by die-casting molding.

Also, there is another slide fastener, as disclosed in Japanese Patent Publication No. 7-110245, comprising an undercoating paint layer mounted on a surface of each filament fastener element, a metal coating layer with a thickness of approximately in a range of 500 to 1000 A mounted on a surface of the paint layer, and a skim coat paint layer mounted on a surface of the metal coating layer.

Further, there is still another slide fastener, as disclosed in Japanese Patent No. 2613802, comprising a metal coating layer with a thickness in a range of 0.001 to 1 $\mu$m formed on a surface of each filament fastener element and a metal coating layer with a thickness of 0.01 $\mu$m or more on a core string inserted inside the filament fastener element row to apply metallic gloss.

The above first conventional slide fastener having the retroreflective function can not be easily applied to filament fastener elements made of synthetic resin, because it is required to form a large number of hemispherical recessed hole to have the reflector faces on the surfaces of the fastener elements made of synthetic resin by injection molding.

The above second conventional retroreflective slide fastener is difficult to be applied to the filament fastener elements and a mounting thread, because the retroreflective tape is mounted on the surfaces of the various fastener elements in the longitudinal direction by bonding, fusing, or sewing.

The above third and fourth conventional slide fasteners include the filament fastener elements having on their surfaces the metal coating layers to have metallic gloss, but do not have a retroreflective function. Also, because a sewing thread used for sewing the filament fastener elements having the metal coating layers to the side edges of the fastener tapes may be a sewing thread of a normal form and may be a transparent sewing thread, the slide fasteners do not have the retroreflective function at all.

SUMMARY OF THE INVENTION

The present invention has been accomplished with the above problems in view, and it is an object of the invention to easily produce a slide fastener having a retroreflective function from filament fastener element rows made of thermoplastic resin and having on their surfaces with retroreflective layers and a mounting thread including a retroreflective layer, and to provide a retroreflective filament slide fastener which can exhibit an excellent retroreflective function.

Another object of the invention is to provide a retroreflective filament slide fastener, in which it is possible to provide the retroreflective function to the filament fastener element rows made of the thermoplastic resin, by using simple means.

Still another object of the invention is to easily produce the mounting thread which can easily exhibit the retroreflective function, by specifying a form of the mounting thread including the retroreflective layer, and to provide a retroreflective filament slide fastener which exhibits an excellent retroreflective effect using the mounting thread.

Further object of the invention is to provide a retroreflective filament slide fastener, in which various forms of filament slide fasteners having retroreflective functions can be easily produced, by specifying manner of use of the mounting thread including the retroreflective layer.

And further object of invention is to provide a retroreflective filament slide fastener which can more clearly exhibit the retroreflective function, by using a reinforcing member such as a core string or a blade.

To achieve the above objects, according to a first aspect of the invention, there is provided a retroreflective filament slide fastener, in which filament fastener element rows are formed from wire rods made of thermoplastic resin, the filament fastener element rows being provided with retroreflective layers on their surfaces, and the filament fastener element rows having the retroreflective layers are mounted to longitudinal edges of fastener tapes by means of mounting threads each including a retroreflective layer.

According to a second aspect of the invention, there is provided a retroreflective filament slide fastener, in which the filament fastener element rows having the retroreflective layers are produced by forming coupling head portions for the slide fastener by pressing and simultaneously forming various types of fastener element rows, and then covering the filament fastener element rows with retroreflective paint to form the retroreflective layers.

According to a third aspect of the invention, there is provided a retroreflective filament slide fastener in which the mounting thread having the retroreflective layer is formed by winding a retroreflective film with a small width around a surface of a synthetic fiber thread of a monofilament or multifilament as a core thread or by twisting the synthetic fiber thread and the retroreflective film with a small width together to form the retroreflective layer.

According to a fourth aspect of the invention, there is provided a retroreflective filament slide fastener in which the mounting thread having the retroreflective layer is formed by covering a surface of a transparent synthetic fiber thread of a monofilament or multifilament with retroreflective paint to form the retroreflective layer.

According to a fifth aspect of the invention, there is provided a retroreflective filament slide fastener in which the mounting thread having the retroreflective layer is used as a sewing thread, and each the retroreflective filament fastener element row having the retroreflective layer is sewn on the longitudinal edge of the fastener tape by the sewing thread.

According to a sixth aspect of the invention, there is provided a retroreflective filament slide fastener in which the mounting thread having the retroreflective layer is used as an anchoring warp yarn, and each the retroreflective filament fastener element row having the retroreflective layer is knitted into a longitudinal edge of warp-knit fastener tape using the anchoring warp yarn.

According to a seventh aspect of the invention, there is provided a retroreflective filament slide fastener in which the mounting thread having the retroreflective layer is used as an anchoring warp yarn and double-pick element anchoring weft yarn, and each the retroreflective filament fastener element row having the retroreflective layer is woven into a longitudinal edge of a double-pick fastener tape using the element anchoring warp yarn and the double-pick element anchoring weft yarn.

According to an eighth aspect of the invention, there is provided a retroreflective filament slide fastener in which a core string having a retroreflective layer on its surface is inserted inside each of the retroreflective filament fastener element rows having the retroreflective layer and the filament fastener element rows are mounted on the longitudinal edges of the fastener tapes.

According to a ninth aspect of the invention, there is provided a retroreflective filament slide fastener in which a blade having a retroreflective layer on its surface is disposed on each of the retroreflective filament fastener element rows and the filament fastener element rows are mounted on the longitudinal edges of the fastener tapes.

DESCRIPTION OF THE PREFERRED EMBODIMENTS

Embodiments of a retroreflective filament slide fastener according to the present invention will be specifically described below, with reference to the drawings.

Figure 1:
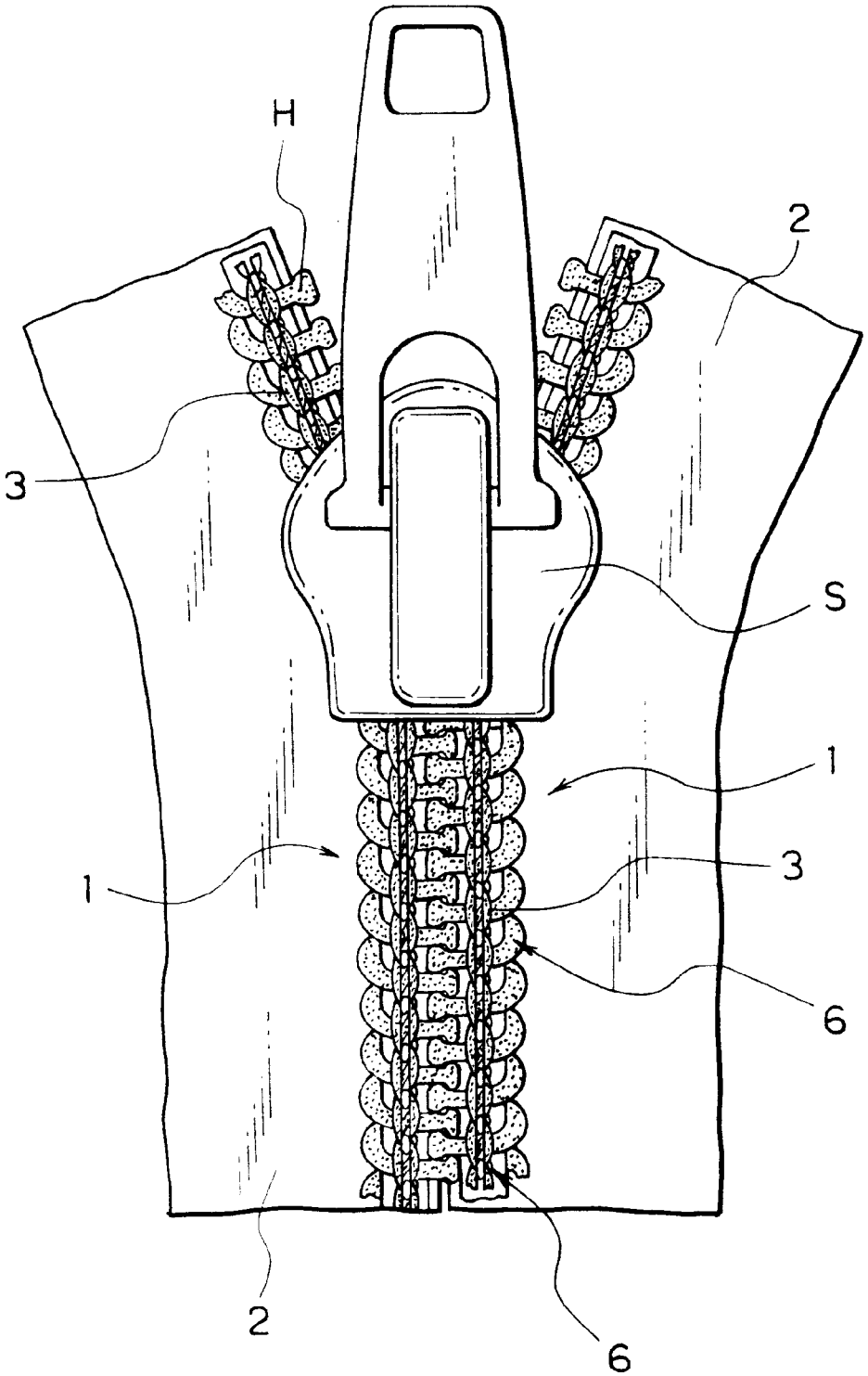
FIG. 1 is a front view of a retroreflective filament slide fastener.

As shown in FIG. 1, the retroreflective filament slide fastener of the invention comprises a fastener chain produced by sewing coil-type filament fastener element rows 1 made of monofilament thermoplastic synthetic fiber of polyamide, polyester, or the like on longitudinal edges of fastener tapes 2 by a multi-thread chain stitch of one needle and two threads using a mounting thread 3 made of synthetic fiber thread 10. In FIG. 1, a reference letter S designates a slider.

Figure 2:
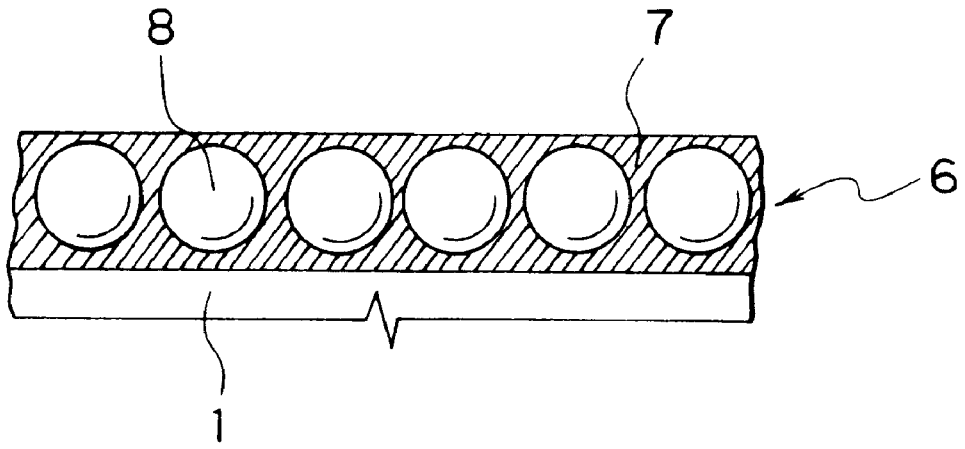
FIG. 2 is a fragmentary enlarged sectional view showing a retroreflective layer formed by bonding retroreflective paint.

As shown in FIG. 2, a retroreflective layer 6 is formed on a surface of the coil-shaped streak fastener element row 1 by applying and covering with retroreflective paint 7 including glass beads 8 or minute spheres made of insoluble resin on the surface. The retroreflective paint 7 is covered on the surface of the filament fastener element row 1, after forming the monofilament of thermoplastic synthetic fiber into a shape of a coil by winding and forming coupling head portions H by pressing, so as to form the fastener element row 1.

Figure 3:
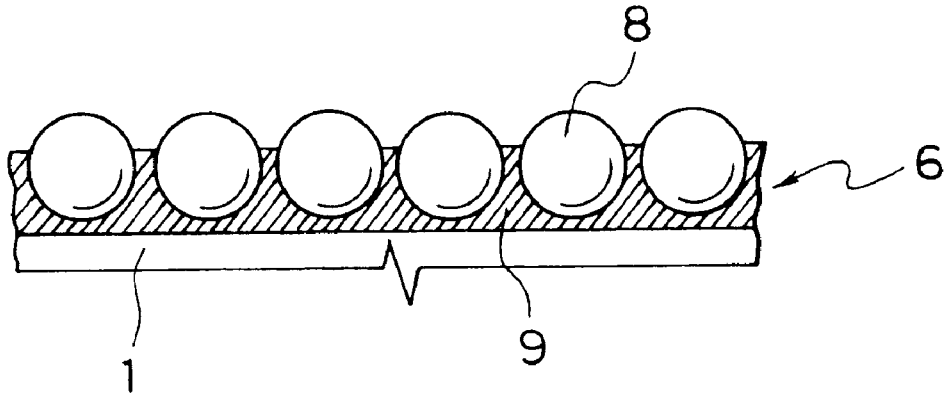
FIG. 3 is a fragmentary enlarged sectional view showing a retroreflective layer formed by spraying glass beads.

The retroreflective layer 6 includes the glass beads 8 and synthetic resin enamel 9 such as polyamide, polyester, the epoxy resin and the like. The retroreflective layer 6 may be formed by previously mixing the glass beads 8 into the resin enamel 9 or by spraying the glass beads 8 by a sprayer to the surface of the filament fastener element row 1 coated with the resin enamel 9, as shown in FIG. 3. If the retroreflective layer 6 is formed by forming a metal coating such as an aluminum vapor deposition coating on the surface of the filament fastener element row 1 in a step previous to covering of the retroreflective paint 7, and applying the retroreflective paint 7 on a surface of the metal coating, an excellent retroreflective function can be obtained.

Figure 4:
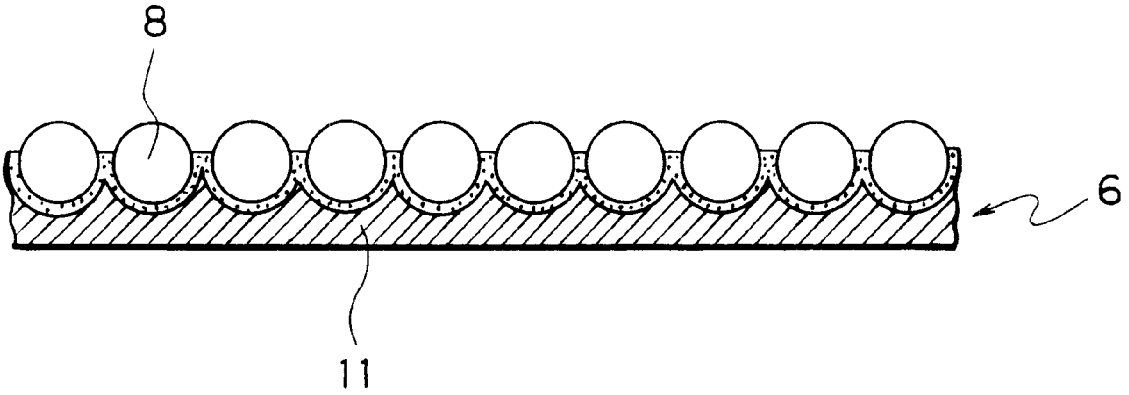
FIG. 4 is a sectional view of a retroreflective film.
Figure 5:
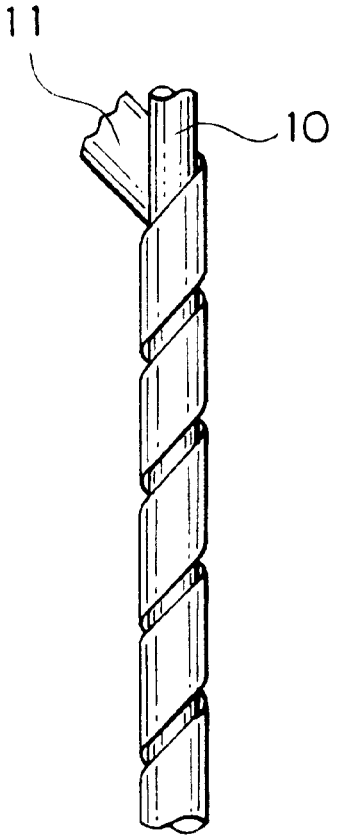
FIG. 5 is a front view of a mounting thread around which the retroreflective film is wound.

As shown in FIG. 5, the mounting thread 3 is formed by winding a retroreflective film 11 around a synthetic fiber thread 10 of polyamide, polyester or the like, as a core thread, or by twisting the retroreflective film 11 and the synthetic fiber thread 10 together, so as to have the retroreflective layer 6 on the mounting thread 3. The retroreflective film 11 which is cut to have a small width is formed with a retroreflective layer 6 by bonding the glass beads 8 to the face of the retroreflective film 11, as shown in FIG. 4.

Therefore, in the fastener chain, the coil-shaped filament fastener element rows 1 having the retroreflective layers 6 are sewn on the longitudinal edges of the fastener tapes 2 using the mounting thread 3 having the retroreflective layer 6 as a sewing thread 12 which is a looper thread for the multi-thread chain stitch. The filament fastener element rows 1 and the mounting thread 3 constitute a retroreflective portion of the fastener chain and retroreflect a light of an automobile at night.

Figure 6:
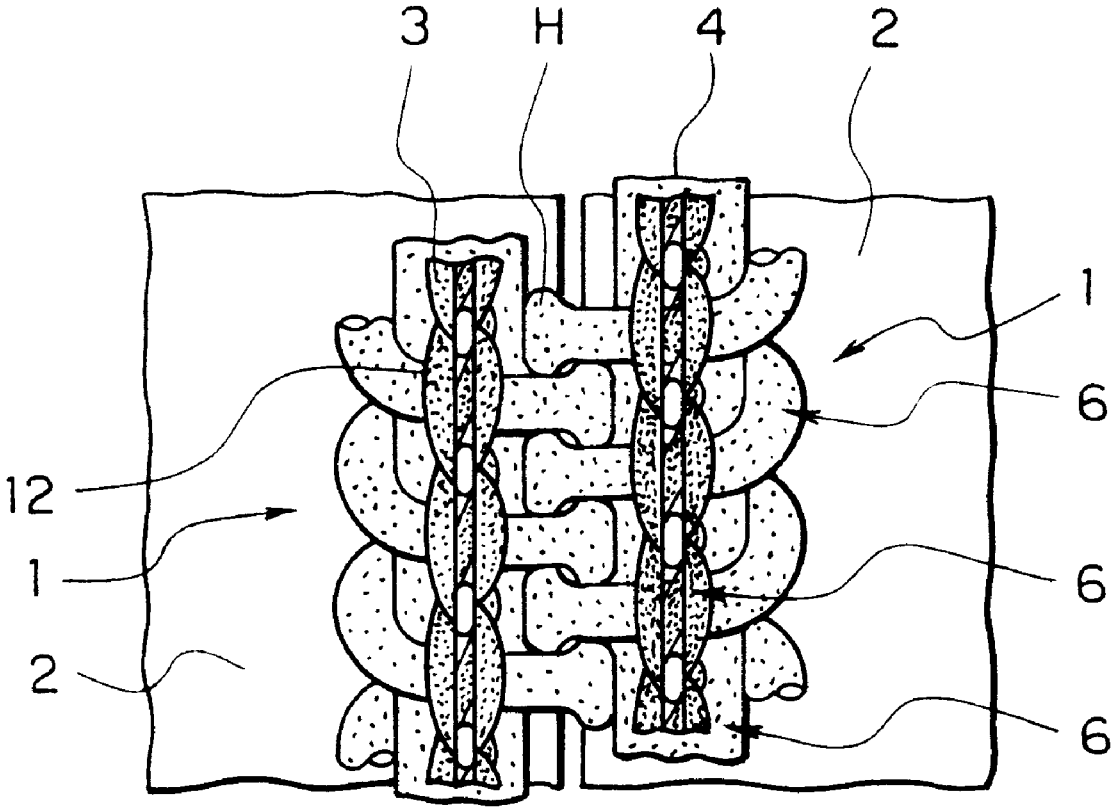
FIG. 6 is a front view of a fastener chain on which coil-shaped filament fastener element rows are sewn.

A fastener chain shown in FIG. 6 is produced by inserting a core string 4 inside each the filament fastener element row 1 formed by winding into a shape of a coil, disposing and sewing the filament fastener element rows 1 on the longitudinal edges of the fastener tapes 2 using the mounting thread 3 as a looper thread of the multi-thread chain stitch and as the sewing thread 12. The retroreflective layer 6 is formed n the surface of each the filament fastener element row 1 and also on the mounting thread 3 as the sewing thread 12.

The core string 4 is formed from a twisted string or a braid made of synthetic fiber thread. The retroreflective layer 6 is formed on a surface of the core string 4 by covering the surface with the retroreflective paint 7 or by winding the retroreflective film 11 around the core string 4. This fastener chain has an excellent retroreflective function, because the retroreflective portion of the fastener chain is formed by the fastener element rows 1, the mounting thread 3, and the core strings 4.

Figure 7:
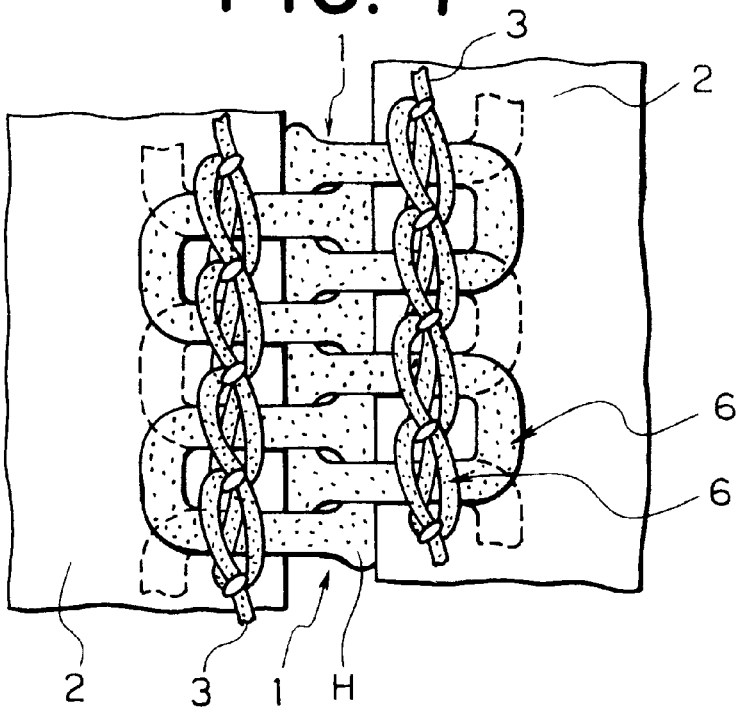
FIG. 7 is a front view of a fastener chain on which zigzag filament fastener element rows are sewn.

In a zigzag-type filament fastener chain shown in FIG. 7, the filament fastener element rows 1 are produced by bending wire rods made of thermoplastic resin in a zigzag shape and forming the coupling heads H by pressing at the same time. The retroreflective layers 6 are formed on the fastener element rows 1 by covering the fastener element rows 1 with the retroreflective paint 7. Each the filament fastener element row 1 is held to sandwich the longitudinal edge of the fastener tape 2. The filament fastener element row 1 is sewn using the mounting thread 3 having the retroreflective layer 6 as the looper thread of the multi-thread chain stitch. The zigzag-shaped filament fastener element rows 1 and the mounting thread 3 both having the retroreflective layers 6 exhibit the retroreflective function.

Figure 8:
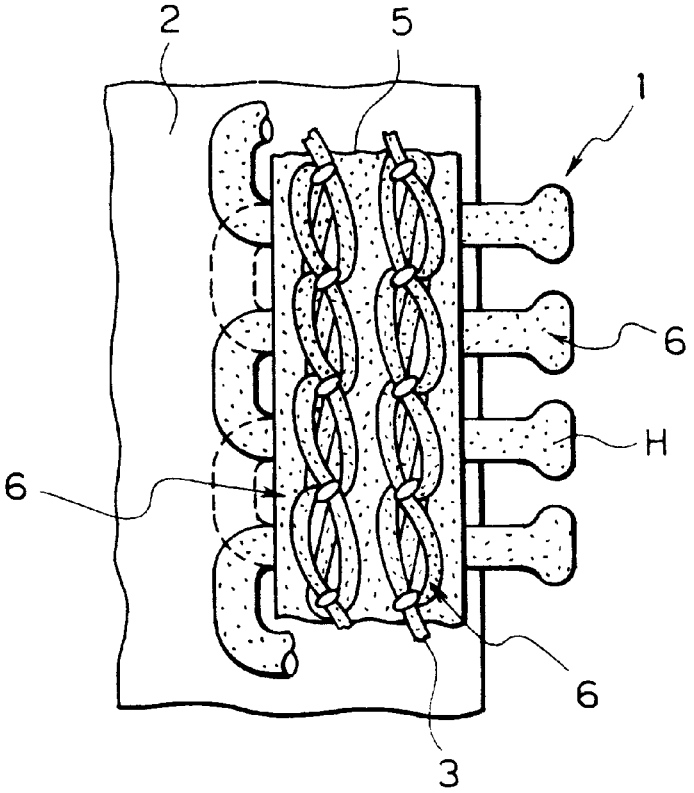
FIG. 8 is a front view of a fastener stringer on which a blade is sewn on the zigzag filament fastener element row.

In a zigzag-type filament fastener stringer shown in FIG. 8, similarly to the example shown in FIG. 7, the filament fastener element rows 1 are formed by bending the wire rods made of the thermoplastic resin into a zigzag shape and forming the coupling head portions H by pressing at the same time. The retroreflective layers 6 are formed on the fastener element rows 1 by covering the fastener element rows 1 with the retroreflective paint 7. After sandwiching the longitudinal edge of the fastener tape 2 by each the filament fastener element row 1, a blade 5 is disposed on the filament fastener element row 1. The blade 5 has the retroreflective layer 6 formed by applying the retroreflective paint 7 on a surface of the blade 5. Then, the blade 5 is sewn using the mounting thread 3 having the retroreflective layer 6 as the looper thread of two lines of multi-thread chain stitch. The zigzag filament fastener element rows 1, the blades 5, and the mounting threads 3 each having the retroreflective layer 6 exhibit the retroreflective function.

Figure 9:
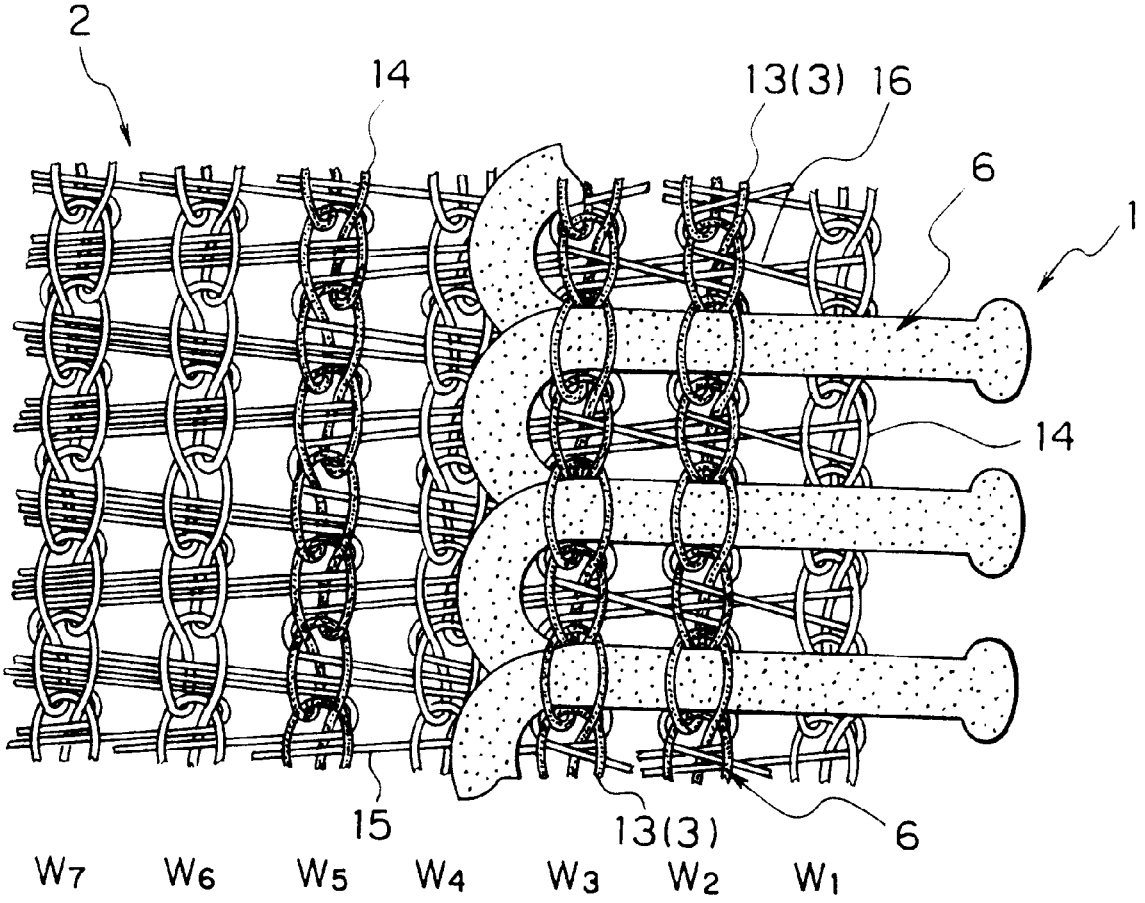
FIG. 9 is a front view of a fastener stringer in which a coil-shaped filament fastener element row is knitted.

In a fastener stringer shown in FIG. 9, the coil-shaped filament fastener element rows 1 are formed by winding the wire rods made of the thermoplastic resin into a shape of a coil. The retroreflective layer 6 is formed on the surface of each the filament fastener element row 1 by covering the surface of the fastener element row 1 with the retroreflective paint 7 similarly to the example shown in FIG. 8. The mounting thread 3 as an anchoring warp yarn 13 having on its surface the retroreflective layer 6 is knitted into the longitudinal edges of the warp-knit fastener tapes 2 to fix the filament fastener element rows 1 to the longitudinal edges of the fastener tapes 2.

The knitting structure of the fastener stringer is produced by interlacing chain stitch yarn 14 of 1-0/0-1 with weft in-laid yarn 15 of 0-0/3-3 in all wales, and providing weft in-laid yarn 16 of 2-2/0-0 to interlace with the weft in-laid yarn 15 in the wales $W_1$ to $W_3$. Further, the chain stitch yarns 14 of $W_2$ and $W_3$ are used as the anchoring warp yarn 13 for fastening and fixing the filament fastener element row 1. As the chain stitch yarns 14, the mounting threads 3 having on the surfaces thereof the retroreflective layers 6 are used.

Therefore, the filament fastener element rows 1 and the mounting threads 3 as the anchoring warp yarn 13 constitute the retroreflective portion and exhibit the retroreflective function. The mounting thread 3 having the retroreflective layer 6 may be used as the chain stitch yarn 14 of $W_5$ to form the retroreflective portion.

Figure 10:
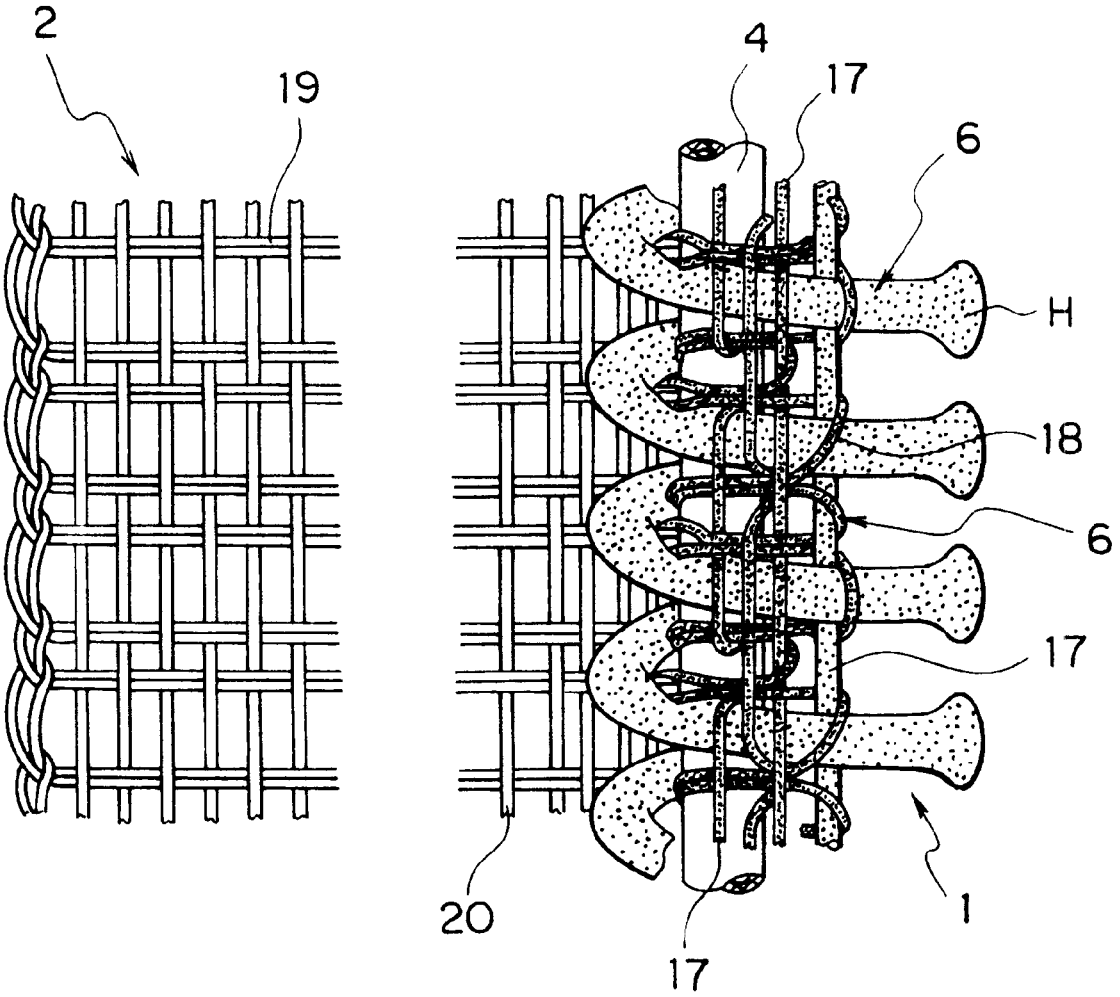
FIG. 10 is a front view of a fastener stringer in which the coil-shaped filament fastener element line is woven.

In a fastener stringer shown in FIG. 10, the coil-shaped filament fastener element rows 1 are formed by winding the wire rods made of the thermoplastic resin into a coil shape. The retroreflective layer 6 is formed on the surface of each the filament fastener element row 1 by covering the surface with the retroreflective paint 7. The filament fastener element row 1 is fixed on the longitudinal edge of the fastener tape 2 by needle weaving using the mounting thread 3 having on its surface the retroreflective layer 6 as an anchoring warp yarn 17 and double-pick anchoring weft yarn 18. Thus the filament fastener element row 1 having the retroreflective layer 6 is woven by the anchoring warp yarn 17 and the anchoring weft yarn 18.

The anchoring weft yarn 18 is used only at the portion corresponding to the filament fastener element rows 1 and is interlaced with the anchoring warp yarn 17 and double-pick texture weft yarn 19 to fasten and fix the coil-shaped filament fastener element rows 1. The core string 4 is inserted inside each the filament fastener element row 1 and the anchoring weft yarn 18 lies across the core string 4 to interlace with the anchoring warp yarn 17. The core string 4 may have on its surface the retroreflective layer 6. In FIG. 10, a reference numeral 20 designates a texture warp yarn.

The retroreflective filament slide fastener according to the present invention having the above-described structure has the following effects.

According to the invention, the retroreflective layers 6 are provided on the surface of the filament fastener element rows 1 produced by forming the wire rods made of thermoplastic resin. The filament fastener element rows 1 are mounted on the longitudinal edges of the fastener tapes 2 by the mounting thread 3 having the retroreflective layer 6. Thus, because the filament fastener element rows 1 which are the most conspicuous at a center of the fastener chain and the mounting threads 3 for mounting the fastener element rows 1 to the fastener tapes 2 are provided with the retroreflective layers 6, a clear retroreflective phenomenon can appear. Also, it is possible to easily produce the filament slide fastener with the excellent retroreflective function.

The various types of fastener element rows 1 are formed and their coupling head portions H are formed by pressing at the same time. Then, the retroreflective layer 6 is formed on each the fastener element row 1 by covering the fastener element row 1 with the retroreflective paint 7. Therefore, the filament fastener element row 1 which exhibits the excellent retroreflective function can be produced easily.

The mounting thread 3 having the retroreflective layer 6 is produced by winding the retroreflective film 11 with the small width around the surface of the synthetic fiber thread 10 as the core thread, or twisting the synthetic fiber thread 10 with the retroreflective film 11, or covering the transparent synthetic fiber thread 10 with the retroreflective paint 7, to form the retroreflective layer 6. Therefore, the mounting thread 3 which exhibits the retroreflective function can be produced easily.

The retroreflective filament fastener element rows 1 are sewn on the fastener tapes 2 using the mounting threads 3 having the retroreflective layers 6 as the sewing threads, or the filament fastener element rows 1 are knitted into the fastener tapes 2 using the mounting threads 3 as the knitting yarns, or the filament fastener element rows 1 are woven into the fastener tapes 2 using the mounting threads 3 as the element anchoring warp yarn 17 and the double-pick element anchoring weft yarn 18. Therefore, the retroreflective filament slide fastener of a sewing, knitting, or weaving type for sewing, knitting, or weaving the filament fastener element rows 1 having the retroreflective function on the fastener tapes 2 can be produced easily, and a clear retroreflective function can be exhibited.

The core string 4 having the retroreflective layer 6 is inserted inside each the retroreflective filament fastener element row 1 and the filament fastener element row 1 is mounted on the fastener tape 2. Therefore, a quality retroreflective function can be maintained for a long time in a clear state.

The blade 5 having the retroreflective layer 6 is disposed on each the retroreflective filament fastener element row 1, and the filament fastener element row 1 is mounted on the fastener tape 2. Therefore, a quality retroreflective function can be maintained for a long time in a clear state. As described above, the remarkable effects can be obtained by the invention.

What is claimed is:

1. A retroreflective filament slide fastener comprising filament fastener element rows formed from wire rods made of thermoplastic resin having retroreflective layers on surfaces thereof, the filament fastener element rows being mounted to longitudinal edges of fastener tapes by means of mounting threads each including a retroreflective layer.

2. A retroreflective filament slide fastener according to claim 1, wherein the filament fastener element rows are produced by forming coupling head portions by pressing and simultaneously forming various types of fastener element rows, and then covering the filament fastener element rows with retroreflective paint to form the retroreflective layers.

3. A retroreflective filament slide fastener according to claim 1, wherein the mounting thread having the retroreflective layer is formed by winding a retroreflective film with a small width around a surface of a synthetic fiber thread as a core thread or by twisting the synthetic fiber thread and the retroreflective film together to form the retroreflective layer.

4. A retroreflective filament slide fastener according to claim 1, wherein the mounting thread having the retroreflective layer is formed by covering a transparent synthetic fiber thread with retroreflective paint to form the retroreflective layer.

5. A retroreflective filament slide fastener according to claim 1, wherein each the retroreflective filament fastener element row is sewn on the longitudinal edge of the fastener tape, using the mounting thread having the retroreflective layer as a sewing thread.

6. A retroreflective filament slide fastener according to claim 1, wherein each the retroreflective filament fastener element row is knitted into a longitudinal edge of warp-knit fastener tape, using the mounting thread having the retroreflective layer as an anchoring warp yarn.

7. A retroreflective filament slide fastener according to claim 1, wherein each the retroreflective filament fastener element row is woven into a longitudinal edge of a double-pick fastener tape, using the mounting thread having the retroreflective layer as an element anchoring warp yarn and a double-pick element anchoring weft yarn.

8. A retroreflective filament slide fastener according to claim 1, wherein a core string having a retroreflective layer is inserted inside each of the retroreflective filament fastener element rows and the filament fastener element rows are mounted on the longitudinal edges of the fastener tapes.

9. A retroreflective filament slide fastener according to claim 1, wherein a blade having a retroreflective layer is disposed on each of the retroreflective filament fastener element rows and the filament fastener element rows are mounted on the longitudinal edges of the fastener tapes.

* * * * *